US007891486B2

(12) United States Patent
Takada et al.

(10) Patent No.: US 7,891,486 B2
(45) Date of Patent: Feb. 22, 2011

(54) SHIPPING TRAY FOR OPTICAL ELEMENTS, AND OPTICAL ELEMENT SHIPPED THEREIN

(75) Inventors: Motoo Takada, Saitama (JP); Ryoichi Koseki, Saitama (JP)

(73) Assignee: Nihon Dempa Kogyo Co., Ltd., Tokyo (JP)

( * ) Notice: Subject to any disclaimer, the term of this patent is extended or adjusted under 35 U.S.C. 154(b) by 565 days.

(21) Appl. No.: 12/004,209

(22) Filed: Dec. 20, 2007

(65) Prior Publication Data

US 2008/0149510 A1 Jun. 26, 2008

(30) Foreign Application Priority Data

Dec. 26, 2006 (JP) ..... 2006-350238
Nov. 20, 2007 (JP) ..... 2007-299995

(51) Int. Cl.
*B65D 85/30* (2006.01)
*B65D 85/38* (2006.01)

(52) U.S. Cl. ..... 206/316.1; 206/725; 206/563

(58) Field of Classification Search ..... 206/316.1, 206/701, 725, 722, 706, 707, 708, 726, 728, 206/460, 714, 454, 455, 562, 563, 565; 428/98
See application file for complete search history.

(56) References Cited

U.S. PATENT DOCUMENTS 5,400,904 A * 3/1995 Maston et al. ..... 206/725
5,481,438 A * 1/1996 Nemoto ..... 361/810
5,492,223 A * 2/1996 Boardman et al. ..... 206/710
5,503,858 A * 4/1996 Reskow ..... 426/119
5,551,572 A * 9/1996 Nemoto ..... 206/725
5,648,136 A * 7/1997 Bird ..... 428/76
6,079,565 A * 6/2000 Walsh et al. ..... 206/725
6,631,807 B2 * 10/2003 Nemoto et al. ..... 206/725
7,232,038 B2 * 6/2007 Whitney ..... 211/74
2007/0074996 A1 * 4/2007 Nice et al. ..... 206/714
2007/0215517 A1 * 9/2007 Holler ..... 206/725

FOREIGN PATENT DOCUMENTS

JP HEI9-30593 2/1997
JP 2002-370780 12/2002

* cited by examiner

*Primary Examiner*—Mickey Yu
*Assistant Examiner*—Steven A. Reynolds
(74) *Attorney, Agent, or Firm*—Scott D. Wofsy; Edwards Angell Palmer & Dodge LLP

(57) ABSTRACT

An objective of the present invention is to provide a shipping tray for optical elements that prevents toppling of optical elements during transportation and optimally maintains the optical characteristics of the optical elements. In a shipping tray for optical elements, single edges of a plurality of optical elements, each having two main surfaces formed as horizontal flat surfaces, are sequentially disposed upright in the lateral and longitudinal directions on an adhesive tape provided on a base surface of a main container; and the plurality of optical elements is covered with a cover in which is formed a plurality of concavities for individually accommodating the plurality of optical elements. Each concavity in the cover has an aperture portion provided in a plateau portion thereof, into which is inserted one of the optical elements upright with the free edge side protruding therefrom, and the shape of the aperture portion is oval.

4 Claims, 3 Drawing Sheets

SHIPPING TRAY FOR OPTICAL ELEMENTS, AND OPTICAL ELEMENT SHIPPED THEREIN

FIELD OF THE INVENTION

The present invention relates to a shipping tray for optical elements in which optical elements are shipped and an optical element housed and shipped therein, and, in particular, to a shipping tray for optical elements that ensures that the characteristics of the optical elements are maintained during transportation.

BACKGROUND OF THE INVENTION

Optical elements are formed of materials such as crystal or glass for use after assembly into various kinds of optical devices such as cameras, and demand therefor has recently expanded. Such optical elements are usually housed, shipped, and transported within a shipping tray for optical elements that is formed of a plastic (resin).

DESCRIPTION OF RELATED ART

A prior-art of a shipping tray for optical elements is shown in FIG. 3, where FIG. 3A is a plan view with a cover 2 removed, FIG. 3B is a plan view of the cover, and FIG. 3C is a partial enlarged sectional view as seen in the direction of the arrows II-II of FIG. 3B.

This prior-art shipping tray for optical elements is formed of a main container 1 and a cover 2, each of which being molded (vacuum formed) from transparent plastic sheeting by the use of a mold. The main container 1 has a concave section and has an aperture edge surface. The outer periphery of the main surface of the cover 2 has framing walls 2*a*, and also concavities 3 formed in the lateral and longitudinal directions in one main surface thereof, facing in the directions in which the framing walls 2*a* extend. The other main surface of the cover 2 has grooves 4 crossing between the concavities 3. A flange 2*b* is formed on each of the aperture edge surface of the cover 2 and the framing walls 2*a* of the cover 2.

A plurality of rectangular cushion members 5 formed of a foamed plastic material are affixed horizontally on an internal base surface 1*c* of the main container 1, and a single double-sided adhesive sheet 6 formed of vinyl is laid over the plurality of cushion members 5. Note that various modifications to this configuration are possible, such as a single cushion member 5, or an array of a plurality of the double-sided adhesive sheets 6 in linear form, or both could be single sheets or both could be a plurality of members in linear form. A plurality of optical elements 7 are provided affixed on the double-sided adhesive sheet 6 laid over the cushion members 5, with an outer periphery side surface (edge surface) of each upright in a manner to ensure they do not peel off.

Each optical element 7 is, for example, rectangular (7×8 mm dimension) and has two main (principal) surfaces that are horizontal flat surfaces, where an IR-cut film (not shown in the figures) that prevents the passage of infrared light is formed on one main surface and a reflection-prevention film is formed on the other main surface, by way of example. Optical films such as these IR-cut and reflection-prevention films are formed by means such as deposition on the main surfaces of each optical element 7.

The cover 2 is placed over the main container 1 and each optical element 7 is accommodated within one of the concavities 3 provided in the lateral and longitudinal array. In this case, the outer periphery of the framing walls 2*a* on the outer periphery region of the cover 2 are in close contact with the inner periphery of framing walls 1*a* of the main container 1, and the flanges 1*b*, 2*b* on the aperture edge surface of the main container 1 and the framing walls of the cover 2 come into mutual contact and engage therewith, as shown in FIG. 3C. This prevents the intrusion of dirt from the outside into the main container 1.

After this shipping tray for optical elements is shipped to the user, the user removes the cover 2 from the main container 1, extracts the optical elements 7 in sequence by hand using tweezers or by an automated manipulator, then transfers them to optical devices for installation therein. In such a case, the transfer mean does not touch the two main surfaces of each optical element 7, instead it grasps the outer peripheral side surfaces thereof, by way of example. Note that touching the two main surfaces with tweezers or a manipulator could cause damage the optical films on the optical element, leading to deterioration of the optical characteristics thereof due to the generation of dirt thereon. (Refer to Japanese Patent Laid-Open Publication No. Hei9-30593.)

PROBLEMS WITH THE PRIOR ART

However, the prior-art shipping tray for optical elements of the configuration described above has problems in that jolts or other rough handling during transportation could cause the optical elements 7 to peel off from the double-sided adhesive sheet 6, and the adhesive strength of the double-sided adhesive sheet 6 can weaken with age. For that reason, if the dimensions of the optical elements 7 are smaller than those of the concavities 3, the optical elements 7 could fall over within the concavities 3. Conversely, if the dimensions of the optical elements 7 are greater than those of the concavities 3, the optical elements 7 could lean against the inner peripheral surfaces of the concavities 3, so that each optical element 7 could topple completely, hit a neighboring optical element 7, or stick to the double-sided adhesive sheet 6 after the cover 2 is removed from the main container 1. In addition, this configuration necessitates manual work such as using a marker pen or the like to put positioning marks on the double-sided adhesive sheet 6, during the affixing of the optical elements 7 to the double-sided adhesive sheet 6.

Thus this prior-art of a shipping tray can cause damage to the optical films formed on the main surfaces of the optical elements 7, particularly IR-cut and reflection-prevention films. In addition, when the main surfaces of the optical elements 7 fall over, they come into contact with the adhesive sheet 6, so that adhesive dirt could attach to the main surfaces of the optical elements 7. These problems could lead to deterioration of the optical characteristics of the optical elements 7, making them unusable. Furthermore, any toppling of an optical element 7 will make it impossible for an automated manipulator or the like to grasp the optical element 7 itself, raising problems for the user in that mass-production would be impeded thereby.

OBJECTIVE OF THE INVENTION

An objective of the present invention is to provide a shipping tray for optical elements that prevents toppling of optical elements during transportation and optimally maintains the optical characteristics of the optical elements.

SUMMARY OF THE INVENTION

In a shipping tray for optical elements in accordance with the present invention, single edges of a plurality of optical elements, each having two main surfaces formed as horizontal flat surfaces, are sequentially disposed upright in the lateral and longitudinal directions on an adhesive tape provided on a base surface of a main container; and the plurality of optical elements is covered with a cover in which is formed a plurality of concavities for individually accommodating the plurality of optical elements; wherein each concavity in the cover has an aperture portion provided in a plateau portion thereof, into which is inserted one of the optical elements upright with the free edge side protruding therefrom, and the shape of the aperture portion is oval.

This configuration, first of all, ensures that the aperture portions formed in the cover act as reference to enable the affixing of the optical elements to predetermined positions on the adhesive tape, and also prevents the free edge side of each optical element coming into contact with the inner periphery of the corresponding aperture portion of the concavity if the optical element should peel off from the adhesive tape and fall over during transportation. In addition, since the shape of each aperture portion is oval, the ridge portions of the optical element only come into contact with the edge of the aperture portion so that the two main surfaces thereof do not come into contact therewith. Thus the characteristics of the optical elements can be maintained in an optimal manner and, since the free edge side of each optical element protrudes upward from the corresponding aperture portion, the optical element can be grasped easily by an automated machine such as a manipulator.

In accordance with the present invention, this cover functions as an inner cover, there are lateral and longitudinal grooves around the outer periphery of the concavity, the main container functions as an outer cover, and each aperture portion is closed by that outer cover. This prevents the intrusion of dirt from the outside into the main container, making it possible to keep the optical elements clean.

The present invention also ensures that partition portions that engage with at least one of the lateral and longitudinal grooves are provided in the outer cover. This ensures that the inner cover is fixed by the partition portions of the outer cover, preventing displacement of the inner cover, thus ensuring that each optical element can be accommodated securely within the corresponding concavity.

The present invention further provides a cut-out portion along the two edge sides in the long-axis direction of the oval-shaped aperture portion. This facilitates the intrusion of tweezers or a manipulator when the tweezers or manipulator are used to grasp the two side surfaces of the optical element. This therefore makes it easy to remove each optical element from the shipping tray.

Furthermore, the present invention ensures that, since each optical element has an optical film formed over at least one main surface, only the ridge portions thereof come into contact with the aperture portions, so that the optical characteristics can be maintained optimally with no damage to the optical film that could easily be damaged by such contact.

The present invention also relates to an optical element that is accommodated in the shipping tray for optical elements for transportation. Since an optical film is formed on at least one main surface of each optical element, the present invention provides an optical element such that the ridge portions thereof are prevented from falling over and hitting the aperture portion due to jolting during transportation, thus maintaining the optical characteristics thereof.

BRIEF DESCRIPTION OF THE DRAWINGS

FIG. 1 is illustrative of an embodiment of the shipping tray for optical elements in accordance with the present invention, where

FIG. 3 is illustrative of a prior-art of a shipping tray for optical elements, where

DETAILED DESCRIPTION OF PREFERRED EMBODIMENT

Figure 1A:
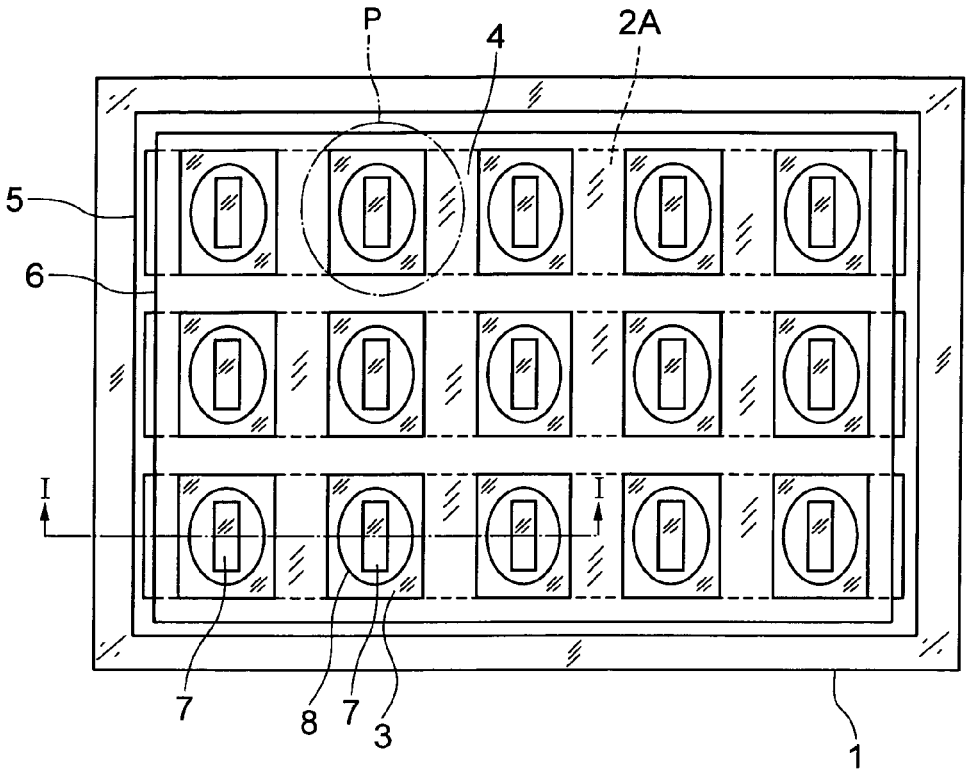
FIG. 1A is a plan view with the outer cover removed and FIG. 1B is a partial enlarged sectional view as seen from the direction of the arrows I-I in FIG. 1A.
Figure 1B:
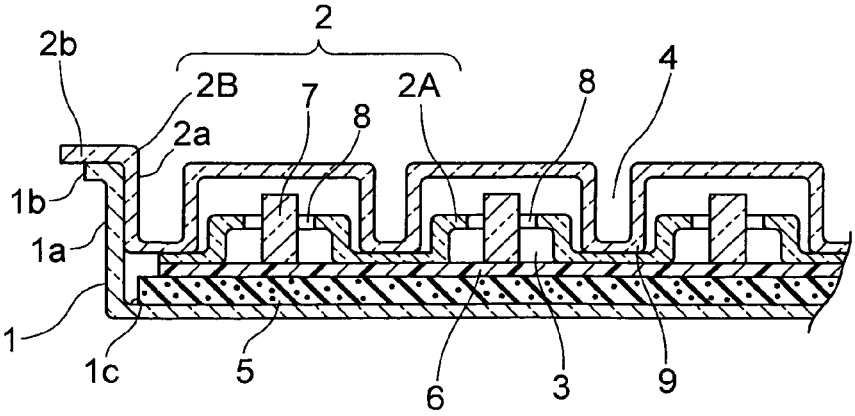

An embodiment of a shipping tray for optical elements in accordance with the present invention is shown in FIG. 1, where FIG. 1A is a plan view with the outer cover removed and FIG. 1B is a partial enlarged sectional view as seen from the direction of the arrows I-I in FIG. 1A. Note that components that are the same as those of the prior-art are given the same reference numbers and further description thereof is abbreviated or omitted.

The shipping tray for optical elements of the present invention is formed of the main container 1 and the cover 2, each of which being molded (vacuum formed) from transparent plastic sheeting by the use of a mold, as described previously. In this case, the cover 2 consists of an inner cover 2A and an outer cover 2B.

The inner cover 2A has a plurality of concavities 3 of a rectangular shape, by way of example, formed in both the lateral and longitudinal directions by pressing, where an aperture portion 8 of an oval shape (such as an elliptical shape) punched out by a die is formed in the base surface of each concavity 3 (a plateau portion of the inner cover 2A). Grooves 4 are formed in the lateral and longitudinal directions around the outer peripheries of the concavities 3, as described previously, and the upper edge surface on the outer peripheral region of the group of concavities is formed as a flat portion.

The outer cover 2B has partition portions 9 protruding horizontally on an internal base surface thereof, and the outer peripheral region has a flange 2*b* that acts as a framing wall. In this case, the flange 2*b* of the outer cover 2B is made wider than a flange 1*b* of the main container 1, to make it easier to remove the outer cover 2B from the main container 1. Each partition portion 9 acts to press on the inner cover 2A when the outer cover 2B is over the inner cover 2A.

In accordance with the present invention, a plurality of rectangular cushion members 5 formed of a foamed plastic material are mounted on the internal base surface 1*c* of the main container 1, the double-sided adhesive sheet 6 is laid thereon, the inner cover 2A having the concavities 3 in which the aperture portions 8 are provided is placed thereon, then one edge of each of a plurality of optical elements 7 (having dimensions of 7×8 mm, by way of example) is affixed upright to the position of each aperture portion 8 in the double-sided adhesive sheet 6, and this assembly is repeated sequentially in the lateral and longitudinal directions so that the free edge sides of the optical elements 7 protrude from the aperture portions 8. The outer cover 2B is then placed over the inner cover 2A and is affixed to the main container 1 by means such as adhesive tape (not shown in the figures), then the entire assembly is shrink-wrapped into plastic film or the like.

In this case, a layer of magnesium fluoride is usually deposited to several μm thick on one main (principal) surface of each optical element 7 as a reflection-prevention film, and an optical film comprising an IR-cut film formed of 40 to 50 layers of silicon dioxide and titanium dioxide is alternately formed on the other main surface thereof.

This configuration ensures that one edge side of an end portion of each optical element 7 can be accurately guided by the aperture portion 8 without any particular positioning marks, to be affixed securely to the double-sided adhesive sheet 6, so that the optical element 7 is housed therein with the free edge side thereof protruding from the aperture portion 8 of the inner cover 2A. The optical element 7 will, therefore, be prevented from falling over since the free edge side or ridge portions thereof will only come into contact with the inner peripheral surface of the aperture portion 8, even if jolting induced during its transportation has caused one edge of the optical element 7 to peel away and the optical element 7 to fall over.

In addition, since the aperture portion 8 has an oval shape (such as an elliptical shape), the ridge portions of the two sides of the optical element 7 will only come into contact with the inner peripheral surface of the aperture portion 8, even if the free edge side of the optical element 7 comes into contact with the inner peripheral surface of the aperture portion 8, so that the two main surfaces of the optical element will not touch the inner peripheral surface of the aperture portion 8. There is, therefore, no damage to any optical films such as IR-cut or reflection-prevention films formed by means such as deposition, particularly on the two main surfaces of each optical element 7. This ensures that the optical characteristics of each optical element 7 can be maintained in a optimal manner.

The user removes the outer cover 2B from the main container 1 but leaves the inner cover 2A in place upon its depacking, then uses means such as tweezers or other manipulator to grasp the free edge surface of the optical element 7 protruding from the aperture portion 8 of the concavity 3. This ensures there is no impediment to the mass-productivity of the optical elements 7. In such a case, the optical elements 7 can be moved during the fabrication stages while the inner cover 2A remains covering the optical elements 7, further increasing the mass-productivity thereof.

Figure 2:
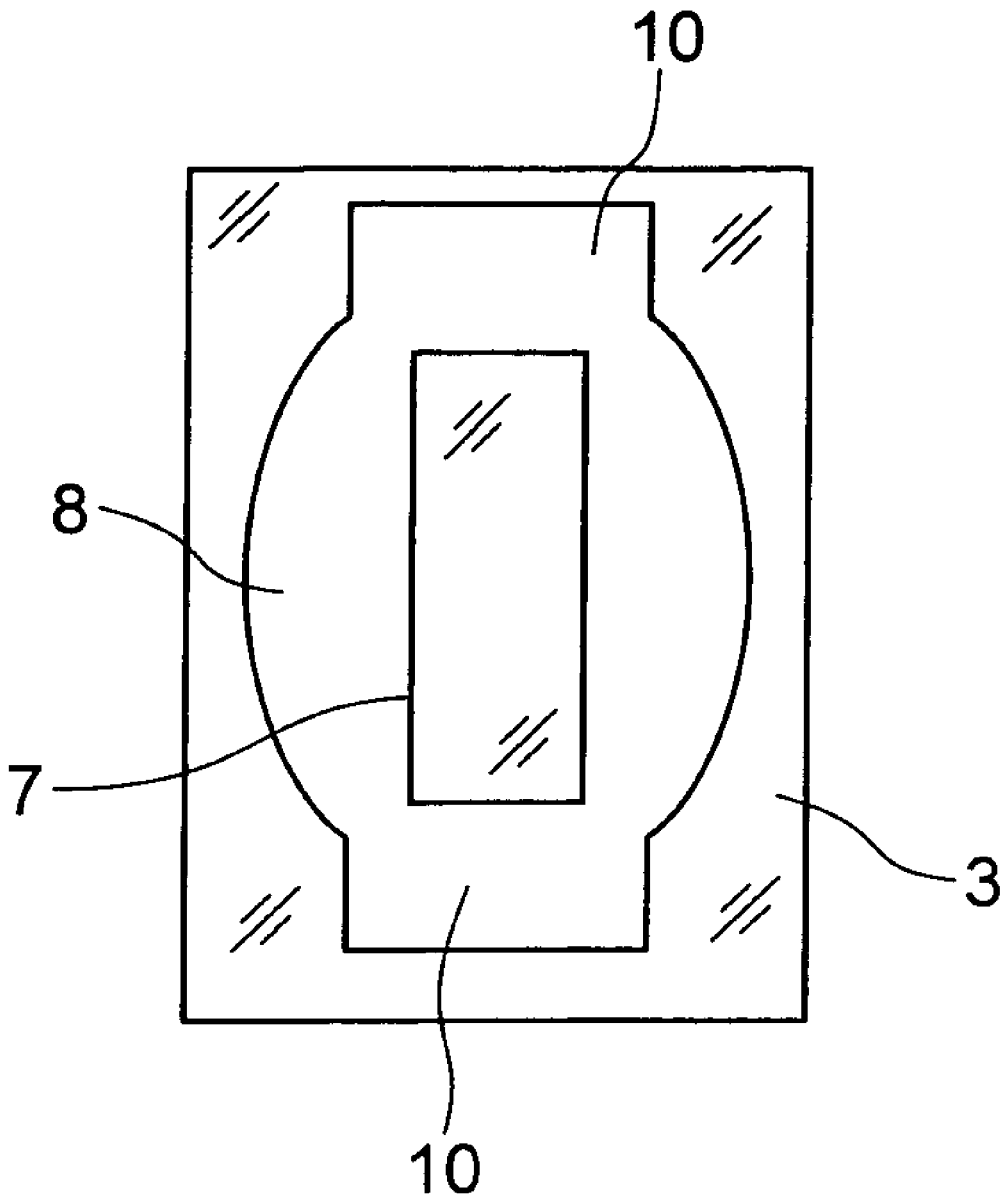
FIG. 2 is a partial enlarged plan view of the concavity portion denoted by P in FIG. 1.
Figure 3A:
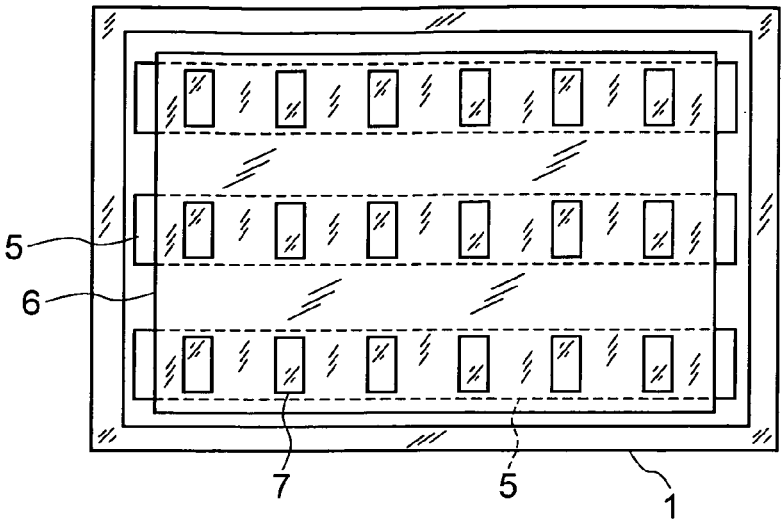
FIG. 3A PRIOR ART
FIG. 3A is a plan view with the cover removed.
Figure 3B:
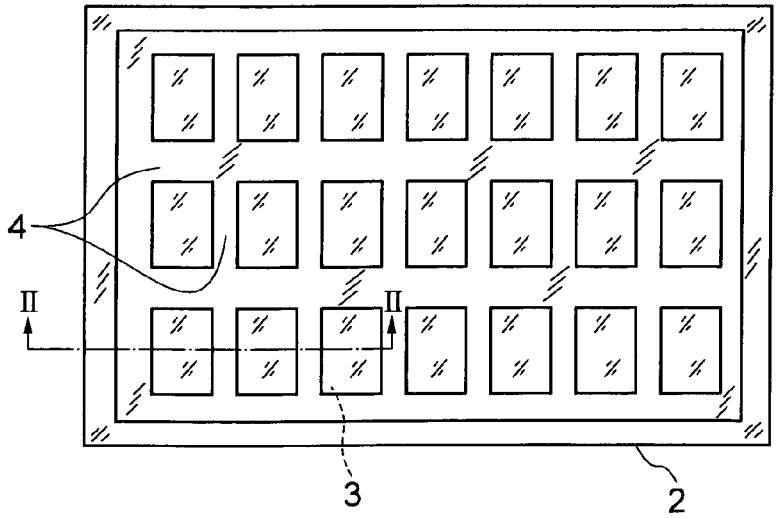
FIG. 3B PRIOR ART
FIG. 3B is a plan view as seen from the cover side.
Figure 3C:
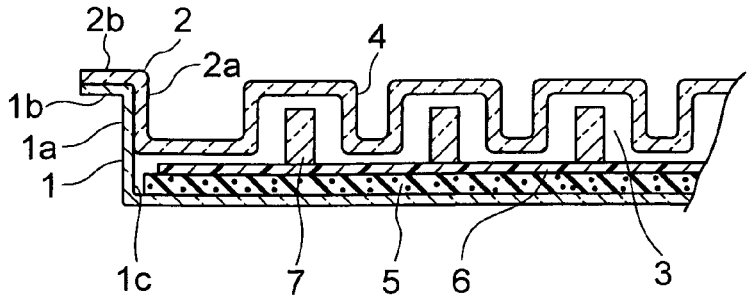
FIG. 3C PRIOR ART
FIG. 3C is a partial enlarged sectional view as seen in the direction of the arrows II-II of FIG. 3B.

In the embodiment described above, the aperture portion 8 of the inner cover 2A had an oval shape, but it could also have a shape such as that shown enlarged in FIG. 2, which is an enlargement of the broken line region denoted by P in FIG. 1, by way of example. In other words, a rectangular cut-out portion 10 can be further provided along the two edges in the long-axis direction of the oval shape, by way of example. This configuration facilitates the intrusion of tweezers or a manipulator when the tweezers or manipulator are used to grasp the two side surfaces of the optical element 7 for removal from the shipping tray, making it easier to remove the optical element 7.

In the embodiment described above, the cushion members 5 for absorbing jolting (vibrations) and preventing peeling are laid below one edge surface of the optical elements 7, but the cushion members 5 could also be omitted. In addition, the double-sided adhesive sheet 6 was used to affix the optical elements 7 upright, but any other adhesive with a weak adhesive strength could be used therefor.

What is claimed is:

1. A shipping tray for optical elements in which single edges of a plurality of optical elements, each having two main surfaces formed as horizontal flat surfaces, are sequentially disposed upright in the lateral and longitudinal directions on an adhesive tape provided on an internal base surface of a main container; and said plurality of optical elements is covered with an inner cover in which is formed a plurality of concavities for individually accommodating said plurality of optical elements; wherein each concavity in said inner cover has an aperture portion provided in a plateau portion thereof, into which is inserted one of said optical elements upright with the free edge side protruding therefrom, and the shape of said aperture portion is oval, wherein lateral and longitudinal grooves are provided on the outer periphery of said concavities, and an outer cover is provided for sealing said aperture portion of said inner cover, and said outer cover has a partition portion that engages with at least one of said lateral and longitudinal grooves.

2. The shipping tray for optical elements according to claim 1, wherein a cut-out is provided in each of two edge sides in the long-axis direction of said oval-shaped aperture portion.

3. The shipping tray for optical elements according to claim 1, wherein said optical element has an optical film on at least one main surface thereof.

4. An optical element housed in the shipping tray for optical elements according to claim 1.

* * * * *